United States Patent [19]

Mousel et al.

[11] Patent Number: 4,993,691

[45] Date of Patent: Feb. 19, 1991

[54] OXYGEN INJECTION LANCE

[75] Inventors: Robert Mousel, Dudelange; Carlo Lux, Bertrange; Francois Knaff, Niederkorn; Henri Klein, Bergem; Romain Henrion, Esch/Alzette; Carlo Heintz, Luxembourg; Michel Decker, Soleuvre; Andre Bock, Luxembourg, all of Luxembourg

[73] Assignee: Arbed S.A., Luxembourg, Luxembourg

[21] Appl. No.: 395,104

[22] Filed: Aug. 17, 1989

[30] Foreign Application Priority Data

Sep. 28, 1988 [LU] Luxembourg ..... 87353

[51] Int. Cl.[5] ..... C21C 5/32

[52] U.S. Cl. ..... 266/225; 266/217

[58] Field of Search ..... 266/225, 266, 216, 217

[56] References Cited

U.S. PATENT DOCUMENTS

| | | | |
|---|---|---|---|
| 4,730,784 | 3/1988 | Bock et al. | 266/266 |

FOREIGN PATENT DOCUMENTS

| | | | |
|---|---|---|---|
| 216032 | 7/1961 | Austria | 266/225 |
| 16768 | 5/1973 | Japan | 266/225 |
| 6710354 | 1/1968 | Netherlands | 266/225 |
| 995688 | 6/1965 | United Kingdom | 266/225 |

*Primary Examiner*—S. Kastler

*Attorney, Agent, or Firm*—Fishman, Dionne & Cantor

[57] ABSTRACT

A gas injection lance for use in metal refining is disclosed. The lance includes a tube having an inner diameter profile and a throttle member slidably received with the tube. The tube and throttle member define an annular gas flowpath. The throttle body may be moved axially within the tube to modify the characteristics of the flowpath.

16 Claims, 2 Drawing Sheets

OXYGEN INJECTION LANCE

TECHNICAL FIELD

The present invention relates to a metallic lance used for the refining of metals or of ferroalloys with the help of a supersonic oxygen stream injected from top into a liquid metal bath contained in a metallurgical vessel.

BACKGROUND

When conceiving an oxygen injection lance, special consideration must be given to a certain number of parameters. Among these parameters the two most important factors are:

- the velocity of the jet at the exit of the tuyere expressed as a Mach number, i.e. relative to the speed of sound which reflects the impact strength of the jet on the surface of the metal bath, and
- the gas throughput, the optimum of which is dependant on the volume of the metal bath in the vessel and on the specific metallurgical effect to be achieved during a given phase of the refining operation.

In order to create a supersonic gas jet, a specially profiled part of the gas conveYing duct, called the tuyere, is located in the lower part of the lance body and comprises, in the direction of the gas flow, a converging part, a cylindrical throat and a diverging part. Such a tuyere is known under the name of Laval tuyere. Calculation shows that the Mach number varies is a function of the pressure of the gas supply source at the entry of the lance. The optimum throughput is a function of the gas pressure at the inlet of the tuyere and of the diameter of the throat of the converging portion of the tuyere.

It appears clearly that the two parameters, which are the Mach number and the gas throughput, are both depending upon the geometric configuration of the tuyere and cannot be varied one independently from the other. This implies that it is for example not possible to operate the refining either with a hard jet at a high Mach number and a reduced gas flow or else with a soft jet at a low Mach number and a high gas flow with the help of one same lance conceived to allow a large gas throughput, without deviating in one direction or in the opposite direction away from the optimum parameters resulting from the geometric configuration of the lance. For example, if the lance is operated at higher flow rates and ejection velocities as those for which the lance has been designed, shock waves are created in the interior of the vessel and in the vicinity of the mouth of the lance. As a result hereof the characteristics of the jet are degraded and the wear of the lance mouth is increasing rapidly.

On the other hand, the metallurgist has very often to face situations where he wants to be able, during certain phases of the refining, to blow onto the metal bath soft vertical gas jets with a high flow rate. This blowing practice is for example, recommended if during hot metal refining a strongly oxidized slag has to be obtained. It happens just as frequently that refining would have to be operated with a vertical gas jet which is hard and penetrating, the flow rate being however low. Such an operating procedure is indicated if the total volume of oxygen to be supplied at given moments to the hot metal in the converter has to be small in order to avoid oxidizing of the slag while a strong decarburizing of the metal has to be held upright. So during a same refining cycle, diametrically opposed blowing conditions, i.e. a hard jet for a small gas throughput or a soft jet for a large gas throughput, might be required.

An oxygen top blowing lance including a Laval tuyere has been described in the U.S. Pat. #4,730,784, the disclosure of which is incorporated herein by reference, which teaches the concept of varying independently one from another and within given limits the Mach number and the optimum flow rate of a main stream, the characteristics of this stream being additionally controlled by a secondary gas envelope. To this end, the pressure of the two gas streams can be modified independently and the effective outlet area of the primary stream can be varied. An increase or a reduction of the cross section of the main duct is achieved with the help of an extremely tapered needlelike member movable within the central profiled tuyere along the axis thereof. This rather sophisticated lance is not very easy to operate and it appeared moveover desirable to further enlarge the limits within which the characteristics of the main gas stream can be changed.

SUMMARY OF THE INVENTION:

In accordance with the present invention, there is provided a Laval tuyere and a movable central throttle body allowing in cooperation to easily modify the injection parameters of a single gas stream within extremely large limits without having recourse to the interaction of an exterior gas envelope. The lance comprises a tube having an inner diameter profile and a throttle member slidably received within the tube. The throttle member comprises a substantially cylindrical throttle body and a throttle nose extending axially from the throttle body. The inner diameter profile of the tube and the throttle member define an annular gas flowpath. The flowpath comprises, in the direction of gas flow, a converging portion, a throat portion and diverging portion. A main feature of the invention lies in the fact that the new Laval tuyere concept can be realized with mechanical means of a very reduced bulkiness, that it allows to control the position of the central throttle body with a reduced driving power and that it comprises a minimum number of moving parts. The generation of turbulences will be avoided or at least reduced to a minimum for any operating manner of this Laval tuyere concept.

Such a Laval tuyere is constituted in a known manner by an inner tube of the lance which has at its different levels different cross sections, namely, seen in the gas flow direction, a convergent portion and a cylindrical throat portion followed by a divergent portion. A substantially cylindrical throttle body, ending in a profiled nose portion, is positioned coaxially to the inner tube in the interior thereof near the borderline of the convergent part, the nose being directed towards the outlet of the tuyere. The throttle body with its profiled nose part can be moved up and down along the central axis of the tuyere by means of a motor, so as to modify the shape of the throughflow passage of the gas. Moreover the nose part of the central throttle body is shaped in such a way that it forms with the coaxial outer cylindrical wall of the tuyere a divergent section giving rise to an expansion of the gas stream. To this end the shaped part of the nose is in substance complementary to the design of the convergent part of the Laval tuyere.

The main advantage of the lance design according to the invention lies in the possibility offered to the steelmaker to easily adjust at any time the blowing conditions to the given metallurgical requirements by varying within the desired limits the volume of the injected refining oxygen, while being able at the same time to impose to the jet always the required optimal velocity and shape.

BRIEF DESCRIPTION OF THE DRAWINGS

The invention is now described more in detail, reference being made to the drawings of which.

Figure 1:
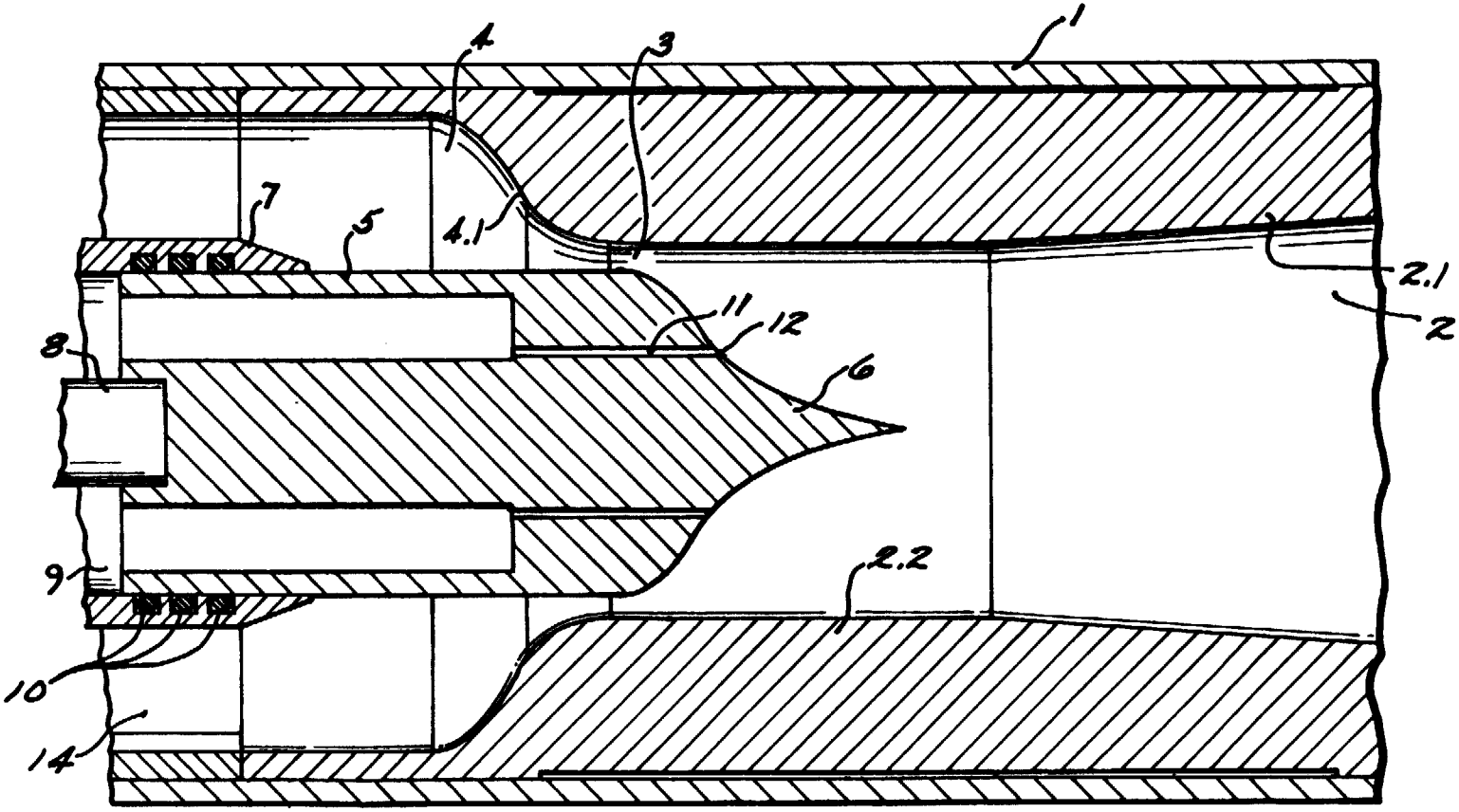
FIG. 1 shows a cross sectional view of the preferred embodiment of that part of a gas injection lance formed by the inner gas conveying tube comprising the Laval tuyere and the profiled nose part of the central throttle body.

DETAILED DESCRIPTION OF THE INVENTION:

FIG. 1 shows the variable section Laval tuyere part with the nose part 6 of the central throttle body 5, which are situated in the center of a lance head part assembly. This assembly comprises in addition to the said parts: outside of the upper extremity of the lance, normally near the point where the lance is connected to its movable support, a regulation valve which allows to vary the inlet gas pressure with the required precision and within appropriate limits, at the lower extremity or nose part of the lance, the exit port (near to the upper part of the drawing) for the gas jet propelled towards the surface of the bath to be treated, and in the radial direction, either a single refractory protection sleeve or an assembling of concentric cooling water conveying metallic conduits situated outwardly with respect to the tube 1. These elements, which are not comprised themselves within the scope of the invention, have not been illustrated.

The illustrated Laval tuyere itself comprises, seen in the gas flow direction, a convergent part 4 followed by a cylindrical throat 3 ending in a divergent part 2. The length and the shape of the divergent part and of the convergent part are designed as a function of the contour and of the position of the nose part 6 of the central throttle body 5 or vice-versa. The length of the cylindrical throat 3 might be extremely short.

Figure 2:
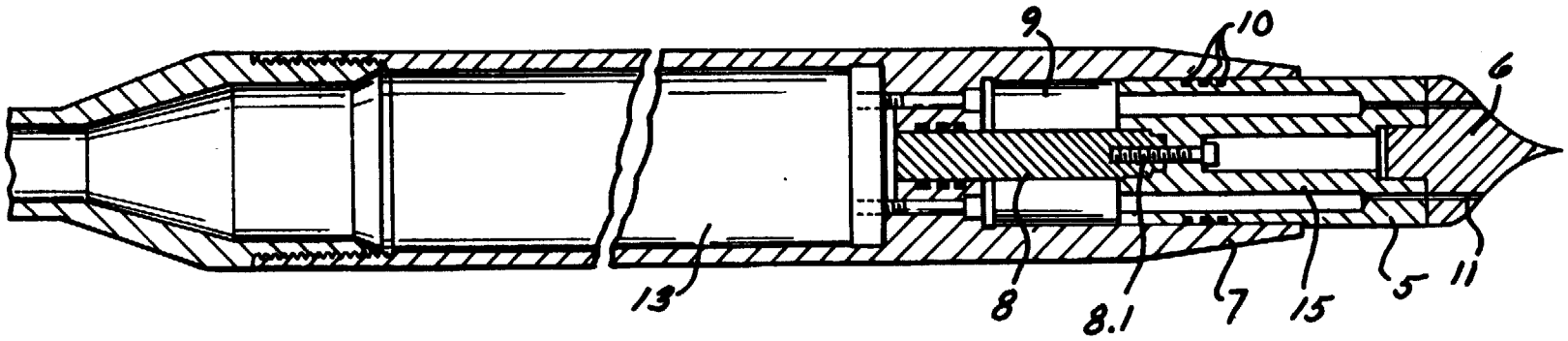
FIG. 2 is a cross sectional view of the complete central throttle body including the housing for the actuating device.

The lower part of the central throttle body 5 is slidably mounted in the upper part of a cylindrical copper housing 7, as can be seen in FIG. 2. The housing 7 is itself rigidly connected through the intermediary of distance pieces 14 shown in FIG. 1 to the oxygen conveying lance tube 1. The whole throttle body 5 can be moved up and down along the axis of the lance with the aid of an actuating device, which might be for example a linear step-by-step motor. To this end, it is connected in an exchangeable manner, for example with the aid of a screw 8.1, to a push-pull rod 8 guided by a positioning cylinder 15 linked to the motor 13. This motor is actuated through the intermediary of an electronic controller which computes the input data, as for example those relating to the actual flow rate, the desired flow rate and the actual position of the push/pull rod and emits the signal for the repositioning of the push/pull rod.

Upstream the convergent part 4 of the tuyere, the chamber 9 is rendered impervious to the oxygen flowing through the main duct by the O-rings 10. It communicates however with the area of the throat part 3 of the oxygen conduit through the grooves 11, which extend axially from the chamber 9 to the surface of the profiled nose part 6 of the central throttle body 5. Due to this measure, the actuating device can be of a substantially lower power. Indeed, the depression acting along the contour of the profiled nose 6—depression which will be variable according to the considered point of the nose and according to the operation modus of the lance—will tend to suck the whole central throttle body towards the outlet of the lance. Thanks to the grooves 11, the depression prevailing near the points 12 propagates itself into the interior of the cavity 9.

In the vicinity of the lance port a traditional divergent part, which normally reaches down to the exit level of the lance port, controls the expansion of the gas flow in the usual manner through the intermediary of the tapered wall 2.1. Upstream from this area, the new divergent zone is constituted by the profiled nose part 6, which leads to the expansion of the gas, and by an outer tube 2.2, which has preferably a cylindrical shape. This tube does however not exert any major influence on the expansion dynamics of the gas. The geometric shape of the nose 6 of the central throttle body 5 is depending on the shape of the convergent part 4. This shape is determined, either through calculation or by empirical trials, in such a way that the turbulences remain at a minimum and that the gas is progressively accelerated. It appears that if the profiled nose 6 of the central throttle body 5 has the appropriate shape, the most important part of the expansion of the gas takes place along this nose part 6, and hence the classical divergent part 2.1 loses most of its importance and its suppression is quite envisageable.

The throat 3 according to the invention is constituted by an outer guiding wall having the form of a cylindrical tube with a constant section—just as it was used for the traditional tuyeres—and in addition, by an inner cylindrical guiding wall constituted by the lateral wall of the central throttle body 5. The length of this throat 3 is depending on the position of the central throttle body.

The convergent part 4 is delimited by an inner cylindrical surface constituted by the lateral wall of the central throttle body 5 and by an outer converging profile 4.1 of the wall of the tuyere. Although the shape of the convergent part is less critical than that one of the new divergent profile of the nose part 6, and could in the borderline case be merely a conus, it is of advantage to foresee a profiled wall part 4.1 whose shape is complementary to that one of the nose part 6 of the central throttle body 5.

According to a preferred execution form the intersection of the profiled nose part 6 of the central throttle body 5 with the plans passing through the axis of the tuyere shows parabolic parts which delimit the sharp pointed extremity of the nose and which are related to the body of the central throttle member by substantially circular tracings. The main aim of such a configuration is to avoid any discontinuity liable to create perturbations. The cross sectional area defined by intersection of a plane perpendicular to the axis of the tuyere with the nose part decreases with distance along the axis for the throttle body to the nose tip.

The normal manner of operation consists in selecting a given pressure of the gas source—through the setting of the valve in the gas conduit—and in varying the flow of the gas by modifying the position of the nose part 6 of the central throttle body 5. This allows to modify the flow rate of the gas for a given Mach number without entailing a bursting of the jet. It is however also easily possible to switch over from the more or less routing conditions to limit conditions. So, the softest possible gas jet will be obtained when a low pressure of the gas source is selected and when the central throttle body 5 is protruded to the maximum, thus reducing to a minimum the effective free cross section within the main oxygen duct. The other limit condition consists in an extremely hard gas jet, which is obtained by selecting a high pressure of the gas source and by retracting the central throttle body 5 to the maximum, thus liberating the greatest possible effective free cross section of the throat of the main oxygen duct.

It has to be noticed that if lances with traditional Laval tuyeres are designed either for a soft jet or for a hard jet, they are completely inadapted for refining phases requiring other blowing conditions than those for which they have been designed. A lance designed for supplying a soft jet does not allow a substantial increase in the acceleration of the gas, whereas with a lance designed for supplying a hard jet, the gas quantities to be ejected cannot be increased at will. In both cases, the increase of the pressure of the gas source leads to the generation of shock waves which impede the acceleration of the gas and limit the flow thereof.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A gas injection lance for use in metal refining, comprising:

a tube extending along a central axis and having an inner diameter profile wherein the inner diameter of the tube varies with axial distance along the axis;

a throttle body member slidably received within the tube and movable along the axis, said throttle member comprising;

a substantially cylindrical throttle body, and a throttle nose extending axially from the throttle body, said throttle nose having a profiled surface wherein curves defined by intersection of a plane axially aligned with and passing through the central axis are compound curves having a circular part and a parabolic part and exhibit a central inflection point.

2. A gas injection lance for use in metal refining, comprising:

a tube extending along a central axis and having an inner diametral profile wherein the inner diameter of the tube varies with axial distance along the axis;

a throttle body member slidably received within the tube and movable along the axis, said throttle member comprising:

a substantially cylindrical throttle body, extending from a first end to a second end; and a throttle nose extending axially from the second end of the throttle body, wherein the inner profile of the tube and the throttle member define an annular gas flow path, said flow path comprising in the direction of gas flow: a converging part, a throat portion and a diverging portion;

an inner tubular housing concentric with the tube and defining a cavity surrounding the first end of the throttle body; and means for isolating the cavity from the converging portion of the annular gas flow path.

3. The lance of claim 2, further comprising:

means for providing communication between the cavity and diverging portion of the annular gas flowpath.

4. A gas injection lance for use in metal refining, comprising:

a tube extending along a central axis and having an inner diameter profile wherein the inner diameter of the tube varies with axial distance along the axis;

a throttle body member slidably received within the tube and movable along the axis, said throttle member comprising:

a substantially cylindrical throttle body, and a throttle nose extending axially from the throttle, said throttle nose having a profiled surface wherein curves defined by intersection of a plane axially aligned with and passing through the central axis exhibit a central inflection point;

wherein the inner diametral profile of the diverging portion of the annular gas flow path and the profiled surface of the throttle nose are complementary.

5. A gas injection lance for use in a metal refining process, comprising;

a lance tube extending along an axis, said tube having an inner surface; and nozzle means for delivering a jet of gas from the lance tube at selectable velocities and selectable mass flows onto a surface of a bath of the metal, said nozzle means comprising:

a gas duct extending along the axis having an inner diametral surface extending from the inner surface of the lance tube to a gas outlet, said duct having an inner diametral profile wherein the inner diameter of the duct varies with distance along the axis from the lance tube to the gas outlet;

a throttle member spaced upstream apart from the gas inlet and slidably received within the lance tube and movable along the axis, said throttle member having an outer surface profile defining a substantially cylindrical throttle body portion and a substantially concavely profiled nose portion extending axially downstream from the body portion to a sharp nose tip;

wherein the inner diametral profile and the outer surface profile may be positioned relative to each other by moving the throttle member along the axis to define, in any one of their relative positions, an annular gas flow path, said flow path comprising, in the direction of gas flow, a convergent portion, a throat portion and a divergent portion.

6. The lance of claim 5, wherein the inner diametral surface of the gas duct defines, in the direction of gas flow, a convergent part and a substantially cylindrical part and wherein the convergent portion of the annular gas flow path is defined by the substantially cylindrical throttle body portion and the convergent part of the inner diametral surface, the throat portion of the annular gas flow path is defined by the substantially cylindrical throttle body portion and the substantially cylindrical part of the inner diametral surface and the divergent portion of the annular gas flow path is defined by the nose portion of the throttle member and the substantially cylindrical part of the inner diametral surface.

7. The lance of claim 5, wherein the inner diametral profile further comprises a divergent part down stream of the substantially cylindrical part and wherein the divergent portion of the annular gas flow path is defined by the nose portion of the inner diametral surface and the divergent part of the inner diametral surface.

8. The lance of claim 5, further comprising means for moving the throttle member relative to the gas duct to modify the annular gas flow path.

9. The lance of claim 8, wherein the means for moving comprises a linear motor.

10. The lance of claim 5, wherein curves defined by intersection of a plane is axial alignment with and passing through the axis and the outer surface of the substantially concavely profiled nose portion exhibit a central inflection point.

11. The lance of claim 10, wherein cross sectional areas defined by intersection of a plane perpendicular to and passing through the axis and the throttle member decrease with distance along the axis from the throttle body portion to the sharp nose tip.

12. The lance of claim 10, wherein the curves are compound curves having a circular part and a parabolic part.

13. The lance of claim 5, wherein the throttle nose portion is removably secured to the throttle body portion.

14. The lance of claim 5, further comprising a cylindrical housing concentric with the lance tube and rigidly secured therein and wherein the throttle member is slidably received with the housing, said housing defining an inner cavity for movement of the throttle body.

15. The lance of claim 14, further comprising means for isolating the inner cavity from the annular gas flow path.

16. The lance of claim 15, further comprising means for providing physical communication between the inner cavity and the nose portion of the throttle member near the diverging portion of the annular gas flow path.

* * * * *